US005222612A

United States Patent [19]

Binder

[11] Patent Number: 5,222,612

[45] Date of Patent: Jun. 29, 1993

[54] SHELF FOR LABORATORY CABINETS

[76] Inventor: Peter M. Binder, Saentisstrrasse 74A, D-7770 Ueberlingen, Fed. Rep. of Germany

[21] Appl. No.: 840,789

[22] Filed: Feb. 26, 1992

[30] Foreign Application Priority Data

Feb. 27, 1991 [DE] Fed. Rep. of Germany ..... 4106065

[51] Int. Cl.[5] ..... A47F 5/00

[52] U.S. Cl. ..... 211/153; 211/134; 108/102; 312/330.1

[58] Field of Search ..... 211/134, 153; 312/330.1, 334.7; 108/102

[56] References Cited

U.S. PATENT DOCUMENTS

| | | | |
|---|---|---|---|
| 1,267,330 | 5/1918 | Miller | 312/330.1 X |
| 1,782,523 | 11/1930 | Warren . | |
| 2,049,140 | 7/1936 | Schick | 312/330.1 X |
| 2,311,411 | 2/1943 | Nave . | |
| 3,083,836 | 4/1963 | Bussemer . | |
| 3,385,643 | 5/1968 | Adell | 312/330.1 |
| 3,738,728 | 6/1973 | Eckard | 312/330.1 |
| 4,483,446 | 11/1984 | Miller et al. | 211/153 |
| 4,904,032 | 2/1990 | Jenkins | 211/134 X |

FOREIGN PATENT DOCUMENTS

| | | |
|---|---|---|
| 1109720 | 6/1961 | Fed. Rep. of Germany . |
| 1451127 | 7/1964 | Fed. Rep. of Germany . |
| 1912948 | 8/1964 | Fed. Rep. of Germany . |
| 7518247 | 3/1976 | Fed. Rep. of Germany . |
| 3004288 | 8/1981 | Fed. Rep. of Germany . |

*Primary Examiner*—Robert W. Gibson, Jr.
*Attorney, Agent, or Firm*—Mason, Fenwick & Lawrence

[57] ABSTRACT

A shelf for laboratory cabinets, the cabinet having horizontal vertically spaced guides on the inner walls, the shelf comprising two parallel and vertically separated side bars, the lower of which cooperates with a lower guide on the side wall of the cabinet to support the shelf and the upper of which is spaced apart from the lower side bar by a distance substantially the same but not greater than the vertical spacing between adjacent horizontal guides.

7 Claims, 2 Drawing Sheets

Fig.2
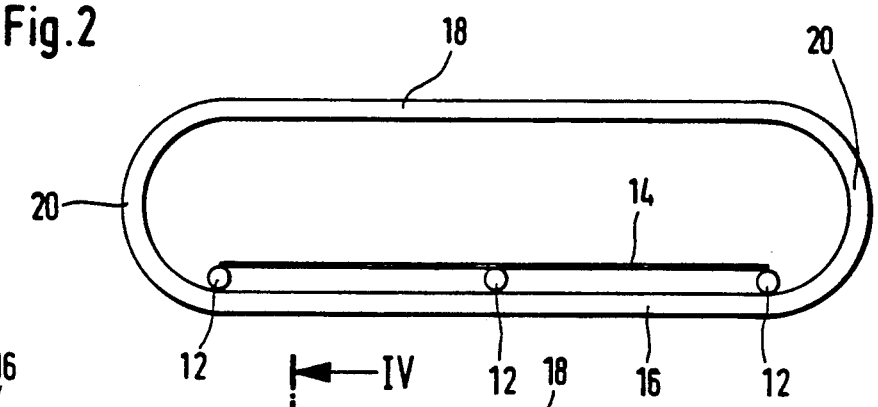
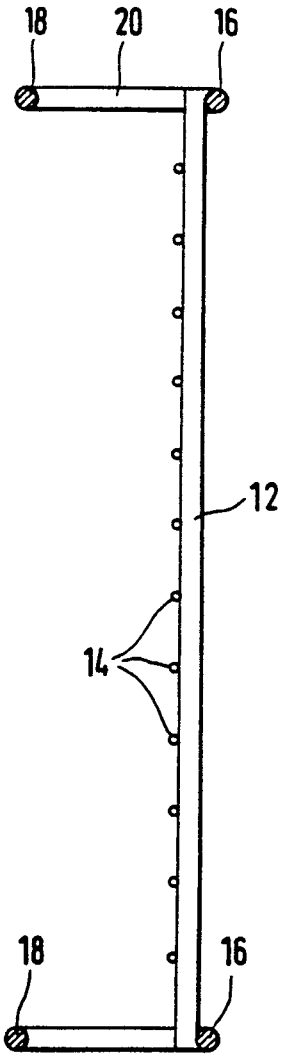
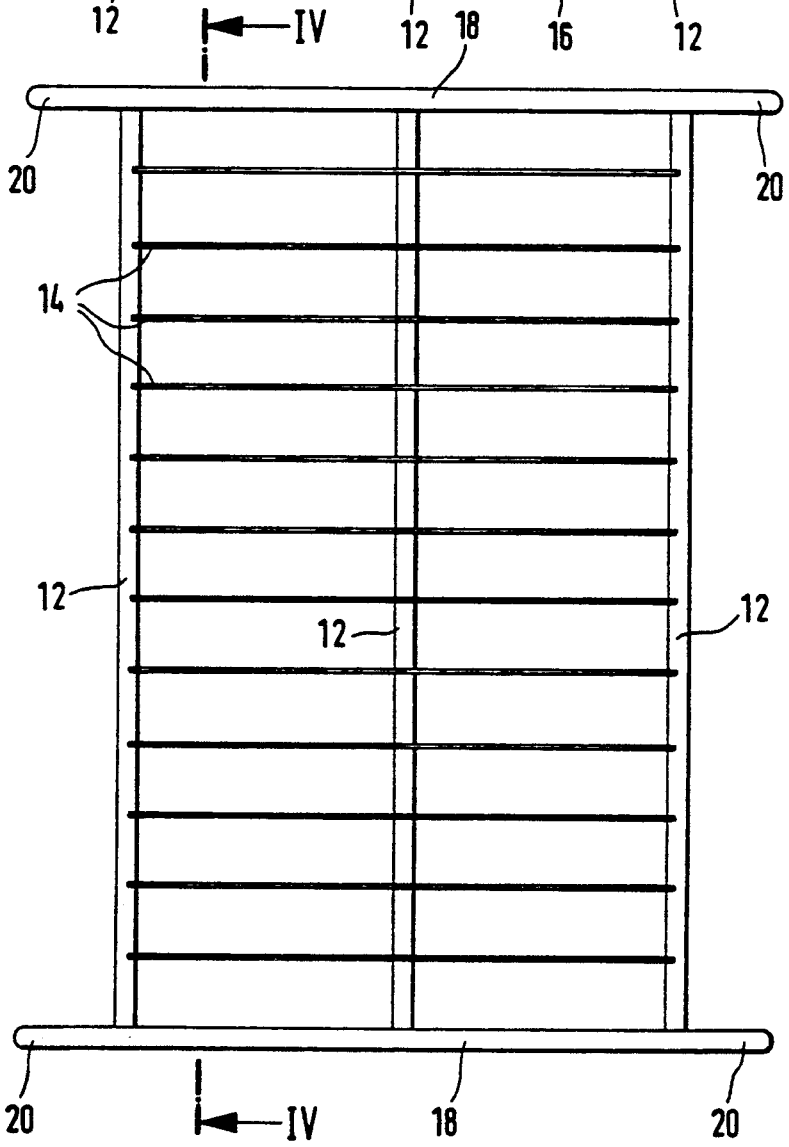
Fig.4
Fig.3

SHELF FOR LABORATORY CABINETS

FIELD OF THE INVENTION

The present invention relates to a shelf for a cabinet and preferably but not exclusively to removable grille or lattice type shelves for laboratory cabinets.

BACKGROUND OF THE INVENTION

Laboratory cabinets for use for example as incubators, heating cabinets, controlled climate cabinets, etc., are often provided with removable shelves, which rest on horizontal guides on the inner side walls of the laboratory cabinet, in the inner working space of the laboratory cabinet. The shelf may be of a grille or lattice type.

The shelf base of such a shelf may consist of a network of cross bars and longitudinal bars, which at the lateral edges extending in the direction of insertion form side bars which bear on the guides. It is also known to form such shelves as perforated trays, the shelf base of which is formed by a perforated metal sheet the edges of which are bent upwards. In the case of such shelves, the side edges extending in the direction of insertion, by means of which the shelf bears on the horizontal guides, have only a small height determined by the diameter of the side bars or by the height of the bent-up edges of the perforated trays.

The horizontal guides on the inner side walls of the laboratory cabinet may be formed by profile rails which are welded onto the inner surface of the inner side wall. The vertical distance between these profile rails can to a large extent be chosen at will. In particular, two profile rails can be located with such a small vertical separation that they enclose the side edges of an insertable lattice shelf pushed in between them with only a little play. In this manner, the insertable lattice shelf is guided without being able to tip over in the direction of insertion or in the transverse direction.

The manufacture and the material costs of profile rails fixed on the inner side walls are expensive. The profile rails also hinder cleaning of the internal space of the laboratory cabinet, which is of the greatest importance in many applications. Finally, the profile rails may also adversely affect air circulation in the internal space of the laboratory cabinet.

It is also known to form the horizontal guides from beadings pressed out in the inner side walls. These beadings can be produced economically and in addition they strengthen the inner side walls. Furthermore, no edges which can hinder cleaning and adversely effect the air circulation are formed on the inner side walls by the beadings. However, the disadvantage of the beadings is that, for material and cost determined reasons, there must be a relatively large vertical distance between them. Therefore the beadings cannot guide the side edges of a conventional shelf from above and so tipping of the shelf both in the direction of insertion and also at right angles to this direction is possible.

SUMMARY OF THE INVENTION

The present invention seeks to provide a removable shelf which can be guided between horizontal beadings on the inner side wall of a cabinet or the like without the possibility of tipping over even when there is a large vertical distance between the horizontal beadings in the inner side walls.

In accordance with one aspect of the present invention, there is provided a shelf for a cabinet having side walls provided with sets of guides spaced along the side walls, each set being arranged to support a shelf thereon at its edge regions, said shelf comprising a side element at at least one of its edges, said side element having a lower part for cooperating with a guide to support the shelf and having an upper part arranged to cooperate with an adjacent guide and spaced from said lower part by a distance substantially similar to that between the guides.

Preferably, the lower and upper parts respectively comprise two vertically separated side bars extending parallel to each other.

At each of the two side edges extending in the direction of insertion, the side bars in a manner of speaking enclose a vertical lateral surface of the shelf which is arranged parallel to the inner side wall of the laboratory cabinet and is located against the inner side wall with only a slight play. These lateral surfaces formed by the side bars prevent slanting and tipping over of the insertable lattice shelf in a transverse direction, i.e. about a tipping axis extending in the direction of insertion.

The vertical height of the lateral surfaces enclosed by the side bars of the shelf is chosen according to the vertical distance between the horizontal guides on the inner side walls. When the shelf bears with the lower edge of the lateral surface on a guide, then the upper edge of the lateral surface is located with a small vertical upward clearance against the next higher guide. Consequently, even when the guides are arranged with a large vertical spacing on the inner side walls, there is lateral guidance of the shelf both from below and from above. Thus, tipping over of the shelf in the longitudinal direction, i.e. about a tipping axis extending at right angles to the direction of insertion, is also prevented and guidance of the insertable lattice shelf with no possibility of tipping during pushing in or pulling out is ensured.

Preferably the two side bars are joined together at their front and rear ends to form a closed loop. The loop forming the two parallel side bars can in this way be bent from a round rod in a simple manufacturing process.

At least one of the ends of at least one of the side bars of each side edge preferably projects beyond the base of the shelf. Advantageously, the side bars project beyond the shelf base at both ends. As a result of this, the side bars form a spacing device on pushing the shelf into the laboratory cabinet which ensures that the shelf base cannot be pushed until it itself bears against the inner rear wall of the laboratory cabinet and that the inner surface of the door of the laboratory cabinet cannot strike against the shelf base when it is closed. Often delicate elements such as, for example, sensors which control operating parameters in the interior of the cabinet, internal lighting, etc. are located on the inner rear wall and the inner surface of the door of the laboratory cabinet. Such elements are protected from damage by the shelf base on pushing in the insertable lattice shelf or on closing the door by the side bars acting as a spacing device. It is also ensured that there is a minimum distance between the shelf base and the inner rear wall so that air circulation on the inner rear wall, which is important for uniform temperature or climatic environment distribution in the internal space, is guaranteed.

The shelf base is preferably fixed on one of the side bars on a side thereof facing the other side bar. Thus, the second side bar in each case is located with a vertical spacing above the shelf base. This is the simplest technical solution from the manufacturing viewpoint. Furthermore, this results in increased versatility. The shelf can be inserted in such a manner that the second side bar is located above or below the shelf base. This results in two different heights of the shelf base relative to the horizontal guides on the inner side walls.

Finally, the side bars connected together into closed loops form on each side of the shelf a well-designed handle which makes possible simple and safe handling of the shelf.

BRIEF DESCRIPTION OF THE DRAWINGS

A specific embodiment of the present invention will now be described with reference to the drawings, in which:

FIG. 2 shows a side view of the shelf of FIG. 1;

FIG. 3 shows a plan view of the shelf of FIG. 1;

FIG. 4 shows a cross-section on the shelf of FIG. 3 along the line IV—IV.

DESCRIPTION OF THE PREFERRED EMBODIMENT

Figure 1:
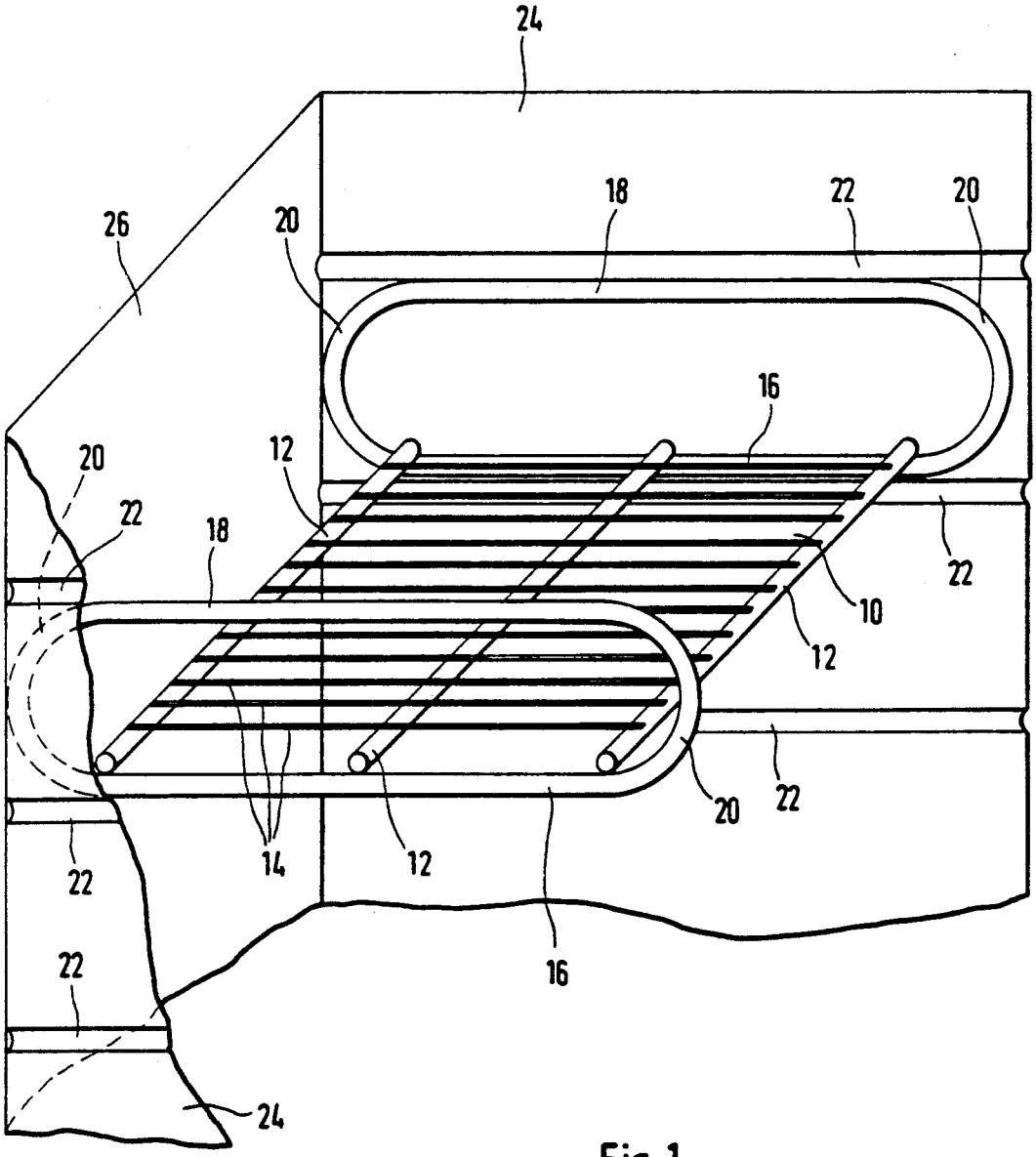
FIG. 1 shows a perspective view of a shelf in the partially broken away interior of a laboratory cabinet.

In the embodiment shown in the figures, a removable shelf comprises a shelf base 10 which consists of a rectangular network of cross bars 12 and longitudinal bars 14.

At the side edges of the shelf base 10, the free ends of the cross bars 12 are in each case fixed by soldering or welding on a side bar 16 extending in a direction in which the shelf is inserted. Above the side bar 16 there is a second side bar 18. The two side bars 16 and 18 extend parallel to one another in the direction of insertion, and their vertical separation is such that the distance between the lower edge of the lower side bar 16 and the upper edge of the upper side bar 18 is only slightly less than the clear vertical spacing between the horizontal beadings 22 acting as guides on the inner side walls 24 of the laboratory cabinet. The two side bars 16, 18 are in each case connected together at their front and rear ends by arcs 20 to that a closed loop is formed which is bent from a single round bar of circular cross-section. The arcs 20 each project in the direction of insertion forward or backwards beyond the shelf base 10. When the shelf is pushed into the laboratory cabinet, the arc 20 which projects forwards comes into contact with the inner rear wall 26 of the laboratory cabinet as can be seen in FIG. 1. As a result, it is ensured that a gap remains free between the inner rear wall 26 and the shelf base 10 which allows a good circulation of air in the internal space. Similarly, the backwardly projecting arc 20 forms a spacing device against the door (not shown) of the laboratory cabinet.

The closed loops formed by the side bars 16 and 18 together with the arcs 20 are located in a vertical plane which extends at right angles to the plane of the shelf base 10. The width of the shelf is slightly less than the clear width of the internal space in the laboratory cabinet between the inner side walls 24. The loops formed by the side bars 16 and 18 are therefore located with a small lateral clearance against the inner side walls 24 of the laboratory cabinet when the shelf is inserted in the laboratory cabinet. The free ends of the cross bars 12 are fixed on the lower side bar 16 in such a manner that their end surfaces are located flush with the plane which touches the outside surface of the side bars, as shown in FIG. 4.

The shelf can be manufactured of stainless steel or be chromium plated.

The claims and specification describe the invention presented, and the terms that are employed in the claims draw their meaning from the use of such terms in the specification. Some terms employed in the prior art may be broader in meaning than specifically employed herein. Whenever there is a question between the broader definition of such term as used in the prior art and the more specific use of the term herein, the more specific meaning is meant.

What is claimed is:

1. A shelf for a cabinet having side walls provided with sets of guides spaced along the side walls, each set being arranged to support a shelf thereon at its edge regions, said shelf comprising a side element at at least one of its edges, said side element having a lower part for cooperating with a guide to support the shelf and having an upper part arranged to cooperate with an adjacent guide and spaced from said lower part by a distance substantially similar to that between the guides, the lower and upper parts of said element respectively comprising two vertically separated side bars extending parallel to each other.

2. The shelf as claimed in claim 1, in which the two side bars are joined together at their front and rear ends to form a closed loop.

3. The shelf as claimed in claim 1, in which at least one of the ends of at least one of the side bars of each side edge projects beyond the base of the shelf.

4. The shelf as claimed in claim 1, in which the side bars are joined together at their ends to form an arc projecting beyond the base of the shelf.

5. The shelf as claimed in claim 1, in which the base of the shelf is fixed to one of the side bars on a side thereof facing the other side bar.

6. The shelf as claimed in claim 1, in which the base of the shelf consists of a rectangular network of cross bars and longitudinal bars and in that the cross bars are fixed at their free ends to the appropriate side bar in such a manner that their end surfaces facing towards the inner side wall are flush with a plane touching the outside surfaces of the side bars.

7. The shelf as claimed in claim 1, wherein the distance between said upper and said lower parts differs from the distance between the guides by a vertical clearance only sufficient to allow a slight play between the shelf and the adjacent guides.

* * * * *